US007501999B2

(12) United States Patent
Shin

(10) Patent No.: US 7,501,999 B2
(45) Date of Patent: Mar. 10, 2009

(54) IMAGE DISPLAY DEVICE AND DRIVING METHOD THEREOF

(75) Inventor: Dong-Yong Shin, Suwon-si (KR)

(73) Assignee: Samsung Mobile Display Co., Ltd., Suwon-si (KR)

( * ) Notice: Subject to any disclaimer, the term of this patent is extended or adjusted under 35 U.S.C. 154(b) by 674 days.

(21) Appl. No.: 10/954,329

(22) Filed: Sep. 29, 2004

(65) Prior Publication Data

US 2005/0093788 A1 May 5, 2005

(30) Foreign Application Priority Data

Oct. 31, 2003 (KR) ..... 10-2003-0076911

(51) Int. Cl.
*G09G 3/30* (2006.01)
*G09G 3/36* (2006.01)

(52) U.S. Cl. ..... 345/76; 345/204

(58) Field of Classification Search ..... 345/76–100, 345/204

See application file for complete search history.

(56) References Cited

U.S. PATENT DOCUMENTS

| | | | | |
|---|---|---|---|---|
| 6,836,269 | B2 * | 12/2004 | Maeda et al. | 345/212 |
| 6,989,826 | B2 | 1/2006 | Kasai | |
| 7,057,589 | B2 | 6/2006 | Shin et al. | |
| 7,106,281 | B2 | 9/2006 | Kim et al. | |
| 7,286,106 | B2 * | 10/2007 | Komiya et al. | 345/82 |
| 2003/0038760 | A1 | 2/2003 | Kim et al. | |
| 2004/0217925 | A1 | 11/2004 | Chung et al. | |
| 2005/0104815 | A1 * | 5/2005 | Komiya et al. | 345/76 |
| 2007/0146251 | A1 | 6/2007 | Tsuge et al. | |

FOREIGN PATENT DOCUMENTS

| | | |
|---|---|---|
| CN | 1402212 | 3/2003 |
| CN | 1427385 A | 7/2003 |
| CN | 1447302 A | 10/2003 |
| EP | 1 347 436 A2 | 9/2003 |
| EP | 1 450 343 A1 | 8/2004 |

(Continued)

OTHER PUBLICATIONS

Korean Patent Abstracts for Publication No. 1020030013273; Date of publication of application Feb. 14, 2003, in the name of T. Kasai.

(Continued)

*Primary Examiner*—Bipin Shalwala
*Assistant Examiner*—Afroza Y Chowdhury
(74) *Attorney, Agent, or Firm*—Christie, Parker & Hale, LLP

(57) ABSTRACT

An image display device having a reduced data programming time. The image display device includes a plurality of pixel circuits, each said pixel circuit for displaying an image which corresponds to a data current, which is applied thereto. The image display device also includes a plurality of data lines for transmitting the data currents to the pixel circuits, and a plurality of scan lines for transmitting select signals to the pixel circuits. A driver applies a precharge voltage to a corresponding one of the data lines in response to a first control signal, and supplies the corresponding one of the data currents to the corresponding one of the data lines in response to a second control signal.

31 Claims, 8 Drawing Sheets

FOREIGN PATENT DOCUMENTS

| | | | |
|---|---|---|---|
| JP | 2003-50564 | | 2/2003 |
| JP | 2003-76327 | | 3/2003 |
| JP | 2003-114645 | | 4/2003 |
| JP | 2003-157049 | | 5/2003 |
| JP | 2003-323152 | | 11/2003 |
| JP | 2004-29803 | | 1/2004 |
| JP | 2004-361935 | | 12/2004 |
| JP | 2005-49430 | | 2/2005 |
| JP | 2005-157319 | | 6/2005 |
| KR | 2003-0013273 | | 2/2003 |
| WO | WO 03/023752 | A1 | 3/2003 |
| WO | WO 03/091980 | A1 | 11/2003 |

OTHER PUBLICATIONS

Patent Abstracts of Japan, Publication No. 2003-050564, dated Feb. 21, 2003, in the name of Shin Asano.

Patent Abstracts of Japan, Publication No. 2003-076327, dated Mar. 14, 2003, in the name of Koichi Iguchi.

Patent Abstracts of Japan, Publication No. 2003-157049, dated May 30, 2003, in the name of Takeshi Okuno et al.

Patent Abstracts of Japan, Publication No. 2004-029803, dated Jan. 29, 2004, in the name of Dong-Yong Shin.

Patent Abstracts of Japan, Publication No. 2004-361935, dated Dec. 12, 2004, in the name of Hajime Kimura.

Patent Abstracts of Japan, Publication No. 2005-049430, dated Feb. 24, 2005, in the name of Hajime Akimoto et al.

Patent Abstracts of Japan, Publication No. 2005-157319, dated Jun. 16, 2005, in the name of Dong-Yong Shin.

* cited by examiner

IMAGE DISPLAY DEVICE AND DRIVING METHOD THEREOF

CROSS REFERENCE TO RELATED APPLICATION

This application claims priority to and the benefit of Korea Patent Application No. 10-2003-0076911 filed on Oct. 31, 2003 in the Korean Intellectual Property Office, the entire content of which is incorporated herein by reference.

BACKGROUND OF THE INVENTION (a) Field of the Invention

The present invention relates to an image display device and a driving method thereof. More specifically, the present invention relates to an organic electroluminescent (EL) display device and a driving method thereof.

(b) Description of the Related Art

In general, an organic EL display electrically excites a phosphorous organic compound to emit light, and it voltage- or current-drives N×M organic emitting cells to display images. As shown in FIG. 1, the organic emitting cell includes an anode (e.g., indium tin oxide (ITO)), an organic thin film, and a cathode layer (metal). The organic thin film has a multi-layer structure including an emitting layer (EML), an electron transport layer (ETL), and a hole transport layer (HTL) for maintaining balance between electrons and holes and improving emission efficiencies. Further, the organic emitting cell includes an electron injecting layer (EIL) and a hole injecting layer (HIL).

Methods for driving the organic emitting cells include a passive matrix method, and an active matrix method using thin film transistors (TFTs). In the passive matrix method, cathodes and anodes are arranged to cross over each other, and lines are selectively driven. On the other hand, in the active matrix method, a TFT is coupled to each ITO pixel electrode to drive an organic emitting cell according to a voltage maintained by capacitance of a capacitor coupled to a gate of the TFT. The active matrix method is classified into a voltage programming method or a current programming method according to signal forms supplied for programming a voltage in the capacitor.

It is difficult for the conventional voltage-programming pixel circuit to obtain high gray scales because of the deviation of the threshold voltage $V_{TH}$ and carrier mobility of a TFT caused by non-uniformity of a manufacturing process. For example, when a TFT is driven by a voltage in the range of 3V (volts), the voltage is applied to a gate of the TFT at intervals of less than 12 mV (=3V/256) in order to represent 8-bit (256) gray scales. Therefore, for example, if the deviation of the threshold voltage of the TFT is 100 mV because of the non-uniformity of a manufacturing process, it becomes difficult to represent the high gray scales.

The current programming type pixel circuit produces substantially uniform display characteristics even if the driving transistor of each pixel has non-uniform voltage-current characteristics, when a current source for supplying the current to the pixel circuit is substantially uniform over the total panel.

FIG. 2 shows a conventional current programming type pixel circuit.

As shown in FIG. 2, the conventional current programming type pixel circuit includes transistors M1, M2, M3, M4 and a capacitor C1. A configuration and an operation of the pixel circuit will now be described.

A source of the transistor M1 is coupled to a power source VDD, and the capacitor C1 is coupled between the source and a gate of the transistor M1. The transistor M2 is coupled between the transistor M1 and an anode of an organic EL element OLED, and transmits the current flowing through the transistor M1 to the organic EL element OLED in response to a second select signal applied to a scan line select2[m]. A cathode of the organic EL element OLED is coupled to a power source VSS.

The transistor M3 is coupled between a data line data[n] and the gate of the transistor M1, and transmits a data current to the gate of the transistor M1 in response to a first select signal applied to a scan line select1[m]. In this instance, the data current $I_{DATA}$ is transmitted to the gate of the transistor M1 until the current having substantially the same magnitude as that of the data current $I_{DATA}$ flows to a drain of the transistor M1.

The transistor M4 transmits the data current $I_{DATA}$ to the drain of the transistor M1 in response to the first select signal applied to the scan line select1[m].

By the above-noted configuration, the current which has substantially the same magnitude as that of the data current $I_{DATA}$ flows to the organic EL element OLED, and the OLED emits light in response to the data current $I_{DATA}$.

A benefit of the conventional current programming type pixel circuit is that the current which flows to the OLED has a substantially uniform characteristic over the whole panel, compared to the voltage programming type pixel circuit. However, the current programming type pixel circuit has a problem of long data programming time since it must charge and discharge parasitic capacitance generated at the data line data[n]. That is, the data programming time in the current programming type pixel circuit is influenced by the level of a voltage stored in the parasitic capacitance of the data line data[n] by the data current of the previous pixel line, and in particular, the data programming time is increased when the difference between the voltage of the data line data[n] and a target voltage (a voltage which corresponds to the current data) is large. This phenomenon becomes more noticeable when the gray level is low (e.g., near the black level) since the voltage of the data line data[n] needs to be modified using a small amount of current.

SUMMARY OF THE INVENTION

In an exemplary embodiment of the present invention, a method for driving an image display device and for reducing a data programming time is provided.

In another exemplary embodiment of the present invention, a precharging method for an image display device in consideration of a deviation of a threshold voltage of a driving transistor is provided.

In still another exemplary embodiment of the present invention, a precharging method for an image display device in consideration of deviations of power levels of pixel circuits included in an image display device is provided.

In one aspect of the present invention, an image display device includes a plurality of pixel circuits, each said pixel circuit for displaying an image which corresponds to a corresponding one of data currents, a plurality of data lines for transmitting the data currents to the pixel circuits, and a plurality of scan lines for transmitting select signals to the pixel circuits. A driver applies a precharge voltage to a corresponding one of the data lines in response to a first control signal, and supplies the corresponding one of the data currents to the corresponding one of the data lines in response to a second control signal.

The first control signal may be applied to the driver before the second control signal is applied.

The precharge voltage is provided within a voltage range which allows the corresponding one of the data currents to be programmed to a corresponding one of the pixel circuits within a select time of a corresponding one of the scan lines.

The driver may apply substantially the same precharge voltage to the data lines.

The precharge voltage may be provided within a range of a voltage charged in a parasitic capacitance of the corresponding one of the data lines when the current in a range from 1/63 to 8/63 of the maximum of the corresponding one of the data currents flows to the corresponding one of the data lines.

The precharge voltage may be a voltage between a first voltage corresponding to a first gray level and a second voltage corresponding to a second gray level when the corresponding one of the data currents is programmed within a select time of a corresponding one of the scan lines coupled to a first said pixel circuit, when the corresponding one of the data currents corresponding to a gray level between the first gray level and the second gray level is applied to another said pixel circuit coupled to another one of the scan lines which is selected before the corresponding one of the scan lines coupled to the first said pixel circuit is selected.

Each said pixel circuit may include: a display element for displaying the image in correspondence to an amount of a current, which is applied thereto; a first power end coupled to a first power source; and a driving transistor for applying the current which corresponds to the data current to the display element, the driving transistor being coupled between the first power end and the display element. The precharge voltage may be a voltage between a second voltage and a fourth voltage when the first voltage is nearer to a voltage of the first power source than the second voltage, a difference between the maximum and an average of absolute values of threshold voltages of the driving transistors included in the pixel circuits may be a third voltage, and a voltage which is far from the voltage of the first power source by the third voltage compared to the first voltage is the fourth voltage.

The precharge voltage may be a voltage between the fourth voltage and a sixth voltage when a difference between the average and the minimum of the absolute values of the threshold voltages of the driving transistors included in the pixel circuits is a fifth voltage, and a voltage which is near the voltage of the first power source by the fifth voltage compared to the second voltage is the sixth voltage.

Each said pixel circuit may include: a display element for displaying the image in correspondence to an amount of a current, which is applied thereto; a first power end coupled to a first power source; and a driving transistor for applying the current which corresponds to the data current to the display element, the driving transistor being coupled between the first power end and the display element. The precharge voltage may be a voltage between a second voltage and a fourth voltage when the first voltage is nearer to a voltage of the first power source than the second voltage, a difference between the maximum and the minimum of voltages of first power ends included in the pixel circuits is a third voltage, and a voltage which is far from the voltage of the first power source by the third voltage compared to the first voltage is a fourth voltage.

The precharge voltage may be a voltage between a seventh voltage and an eighth voltage when a difference between the maximum and an average of the absolute values of the threshold voltages of the driving transistors included in the pixel circuits is a fifth voltage, a difference between the average and the minimum is a sixth voltage, a voltage which is far from the voltage of the first power source by the fifth voltage compared to the fourth voltage is the seventh voltage, and a voltage which is near to the voltage of the first power by the sixth voltage compared to the second voltage is the eighth voltage.

The driver may apply a first precharge voltage to the corresponding one of the data lines for transmitting the corresponding one of the data currents with a gray level of substantially 0 to a corresponding one of the pixel circuits, and may apply a second precharge voltage to other said data lines.

The first precharge voltage substantially corresponds to a power supply voltage applied to the corresponding one of the pixel circuits.

In another aspect of the present invention, a method for driving an image display device including a plurality of pixel circuits, a plurality of data lines for programming data currents to the pixel circuits, and a plurality of scan lines for transmitting select signals to the pixel circuits, is provided. The method includes applying a precharge voltage to a corresponding one of the data lines in response to a first control signal, and supplying a corresponding one of the data currents to the corresponding one of the data lines in response to a second control signal.

In still another aspect of the present invention, a method for establishing a precharge voltage of an image display device including a plurality of pixel circuits is provided. Each said pixel circuit displays an image corresponding to a data current, which is applied thereto, a plurality of data lines for transmitting data currents to the pixel circuits, and a plurality of scan lines for transmitting select signals to the pixel circuits. The method includes applying the precharge voltage to a corresponding one of the data lines before a corresponding one of the data currents is transmitted to the corresponding one of the data lines and the method further includes establishing the precharge voltage to be a voltage between a first voltage corresponding to a first gray level and a second voltage corresponding to a second gray level when a corresponding one of the data currents is programmed within a select time of a corresponding one of the scan lines coupled to a first said pixel circuit, when the corresponding one of the data currents corresponding to a gray level between the first gray level and the second gray level is applied to another said pixel circuit coupled to another one of the scan lines which is selected before the corresponding one of the scan lines coupled to the first said pixel circuit is selected.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, simply by way of illustration. As those skilled in the art would realize, the present invention may be modified in various different ways, all without departing from the spirit or scope of the present invention. Accordingly, the drawings and description are to be regarded as illustrative in nature, and not restrictive.

1. Image Display Device

Figure 3:
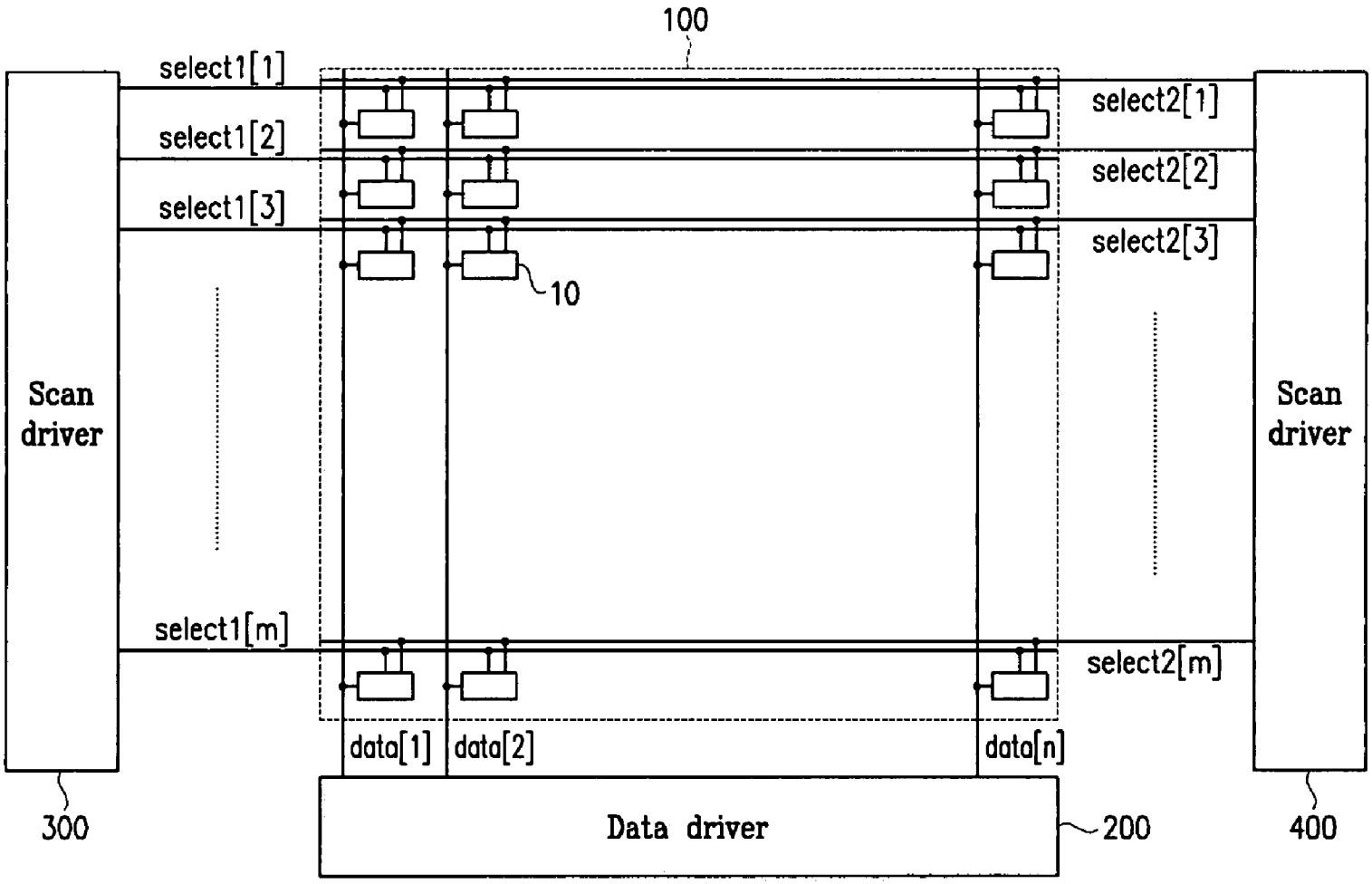
FIG. 3 shows a brief block diagram of an image display device according to an exemplary embodiment of the present invention.

As shown in FIG. 3, an image display device includes an organic EL display panel (referred to as a display panel hereinafter) 100, a data driver 200, and scan drivers 300 and 400.

The display panel 100 includes a plurality of data lines data[1] to data[n] arranged in the column direction, a plurality of scan lines select1[1] to select1[m] and select2[1] to select2[m] arranged in the row direction, and a plurality of pixel circuits 10.

The scan lines select1[1] to select1[m] transmit first select signals for selecting pixels, and the scan lines select2[1] to select2[m] each control a light emitting time of an organic EL element. The pixel circuits 10 are formed at pixel regions defined by the data lines data[1] to data[n], and the scan lines select1[1] to select1[m] and select2[1] to select2[m].

The data driver 200 precharges the data lines data[1] to data[n] with a specific voltage level, and supplies the data current $I_{DATA}$ to the data lines data[1] to data[n]. That is, the data driver 200 includes a voltage source and a current source, couples the data lines data[1] to data[n] to the voltage source to precharge the data lines data[1] to data[n] with a precharge voltage Vpre in a precharge operation, and couples the data lines data[1] to data[n] to the current source so that the data current $I_{DATA}$ may flow to the data lines data[1 ] to data[n] at a time of programming the data. A method for establishing the precharge voltage will be described later.

The scan driver 300 sequentially applies the first select signals for selecting the pixel circuits to the scan lines select1[1] to select1[m], and the scan driver 400 applies the second select signals for controlling a light emitting period of the pixel circuits 10 to the select2[1 ] to select2[m].

The scan drivers 300 and 400 and/or the data driver 200 may be coupled to the display panel 100, and may also be installed as a chip on a tape carrier package (TCP) attached to the display panel 100. In addition, they may be installed as a chip on a flexible printed circuit (FPC) or a film attached and coupled to the display panel 100. Alternatively, the scan drivers 300 and 400 and/or the data driver 200 may be directly installed on a glass substrate of the display panel, and they may be substituted by a driving circuit on the same layer as that of signal lines, data lines, and TFTs on the glass substrate.

Also, while the data driver 200 is described as performing a precharge operation in reference to FIG. 3, a unit for performing the precharge operation can be implemented separately from the data driver 200.

2. Pixel Circuit and Driving Method Thereof

Figure 4:
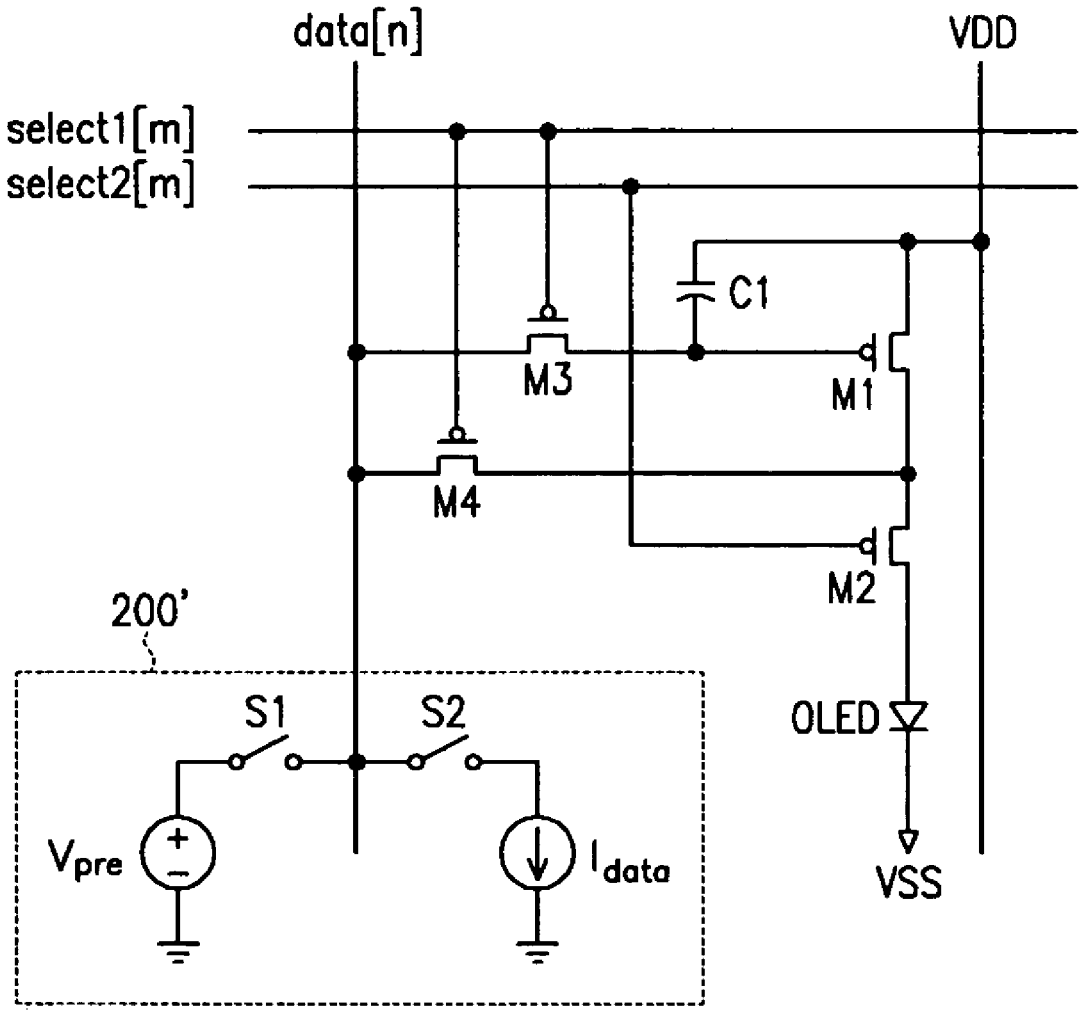
FIG. 4 shows a pixel circuit and a data driving circuit according to an exemplary embodiment of the present invention.
Figure 5:
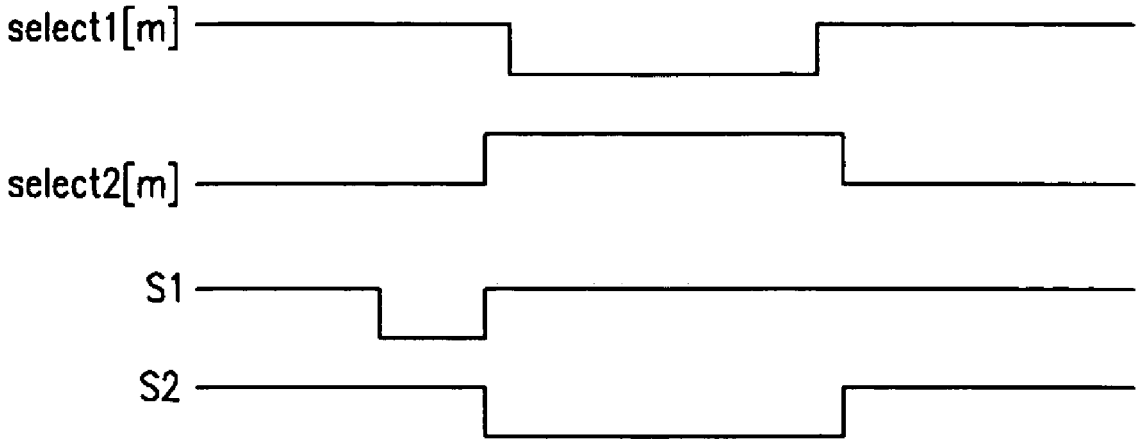
FIG. 5 shows a waveform diagram of respective signals according to an exemplary embodiment of the present invention.

FIG. 4 shows a pixel circuit 10 and a data driver 200' according to an exemplary embodiment of the present invention, and FIG. 5 shows a waveform diagram of respective signals according to an exemplary embodiment of the present invention. It is assumed in FIG. 5 that the respective switches S1 and S2 are turned on when applied control signals are low level.

Figure 1:
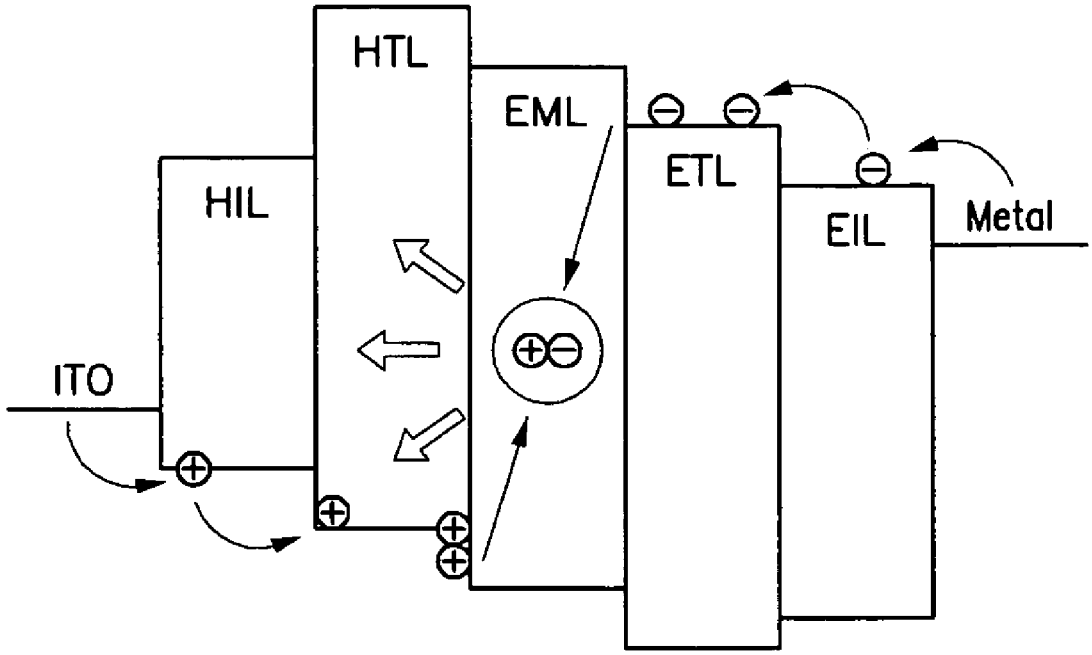
FIG. 1 shows a conceptual diagram of an organic EL element.
Figure 2:
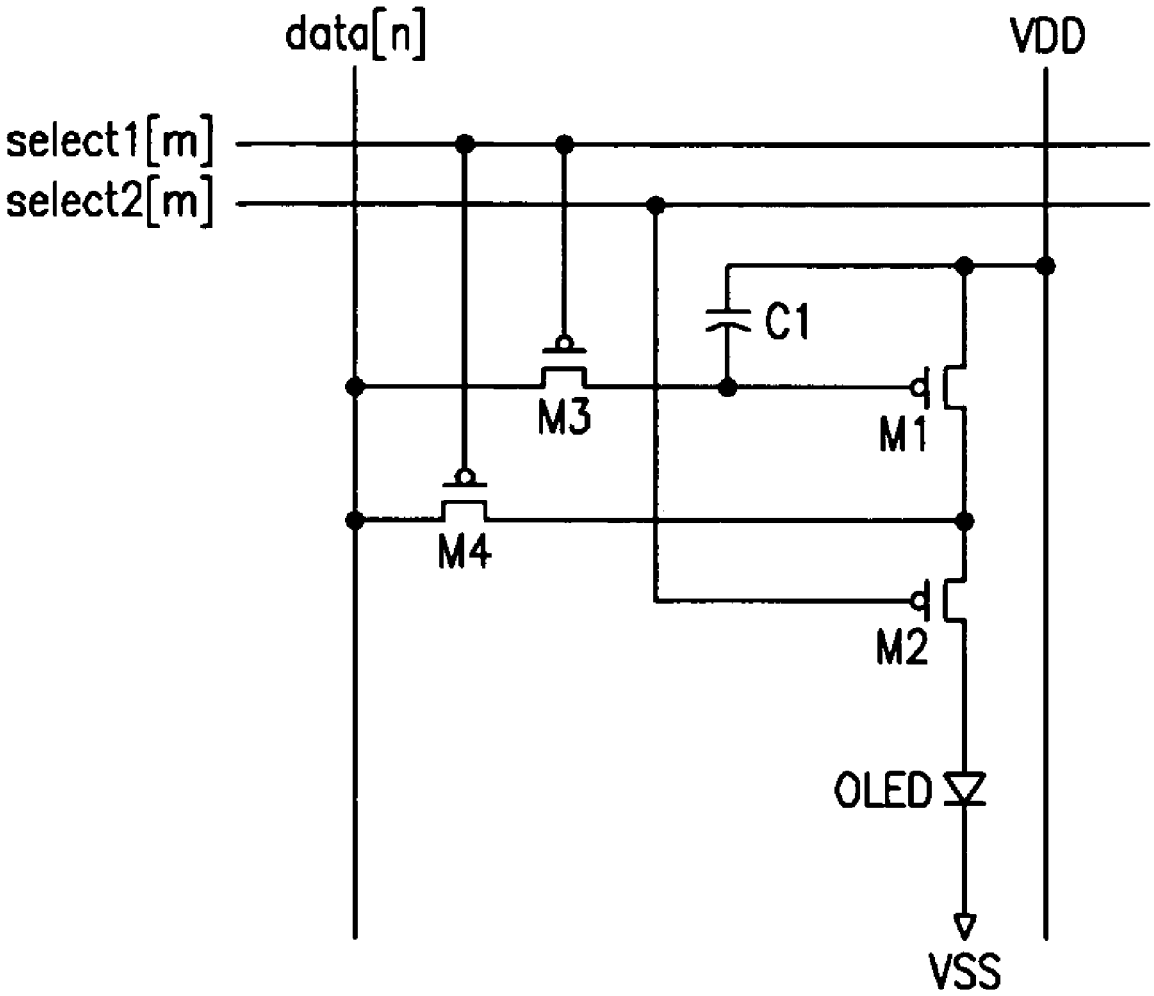
FIG. 2 shows a conventional current programming type pixel circuit.

FIG. 4 shows a case in which the exemplary embodiment according to the present invention is applied to the conventional representative pixel circuit, and since the pixel circuit of FIG. 4 substantially corresponds to that of FIG. 2, no detailed description of the pixel circuit will be provided.

First, a precharge operation for reducing the data programming time is executed before a data programming operation for supplying the data current to the data line data[n] is performed.

As shown in FIG. 5, when a control signal of low level for precharge is applied to the switch S1, the switch S1 is turned on (i.e., closed), and the precharge voltage Vpre is applied to the data line data[n].

After the precharge operation, a low level control signal is applied to the switch S2, and the data current $I_{DATA}$ provided from the data driver 200' is applied to the data line data[n]. Also, the transistors M3 and M4 are turned on in response to the first select signal, the transistor M1 is diode-connected, and a voltage which corresponds to the data current $I_{DATA}$ provided from the data line data[n] is charged in the capacitor C1. In this instance, the capacitor C1 is quickly charged with the voltage which corresponds to the data current $I_{DATA}$ since the precharge voltage is stored in the data line data[n].

When the charging is finished, the transistors M3 and M4 are turned off, and the transistor M2 is turned on in response to the second select signal applied from the light emitting scan line select2[m]. In this instance, a current corresponding to the data current $I_{DATA}$ is supplied to the OLED through the transistor M2, and the OLED emits light in correspondence to the current.

The voltage charging caused by the data current is swiftly performed, and the gray levels are more accurately represented since the data programming operation is performed after the voltage precharging as described.

The switches used for the pixel circuit of FIG. 4 are p-channel transistors M2, M3 and M4. However, a person skilled in the art would recognize that the transistors M2, M3 and M4 can be realized through any other suitable types of transistors for switching both ends by a control signal, such as n-channel transistors.

Also, while FIG. 4 illustrates a case in which the exemplary embodiment has been applied to a specific pixel circuit, the scope of the present invention is not limited to the specific pixel circuit of FIG. 4. On the contrary, the exemplary embodiment of the present invention can be applied to all suitable types of current programming type pixel circuits in which the data programming time matters.

Figure 6:
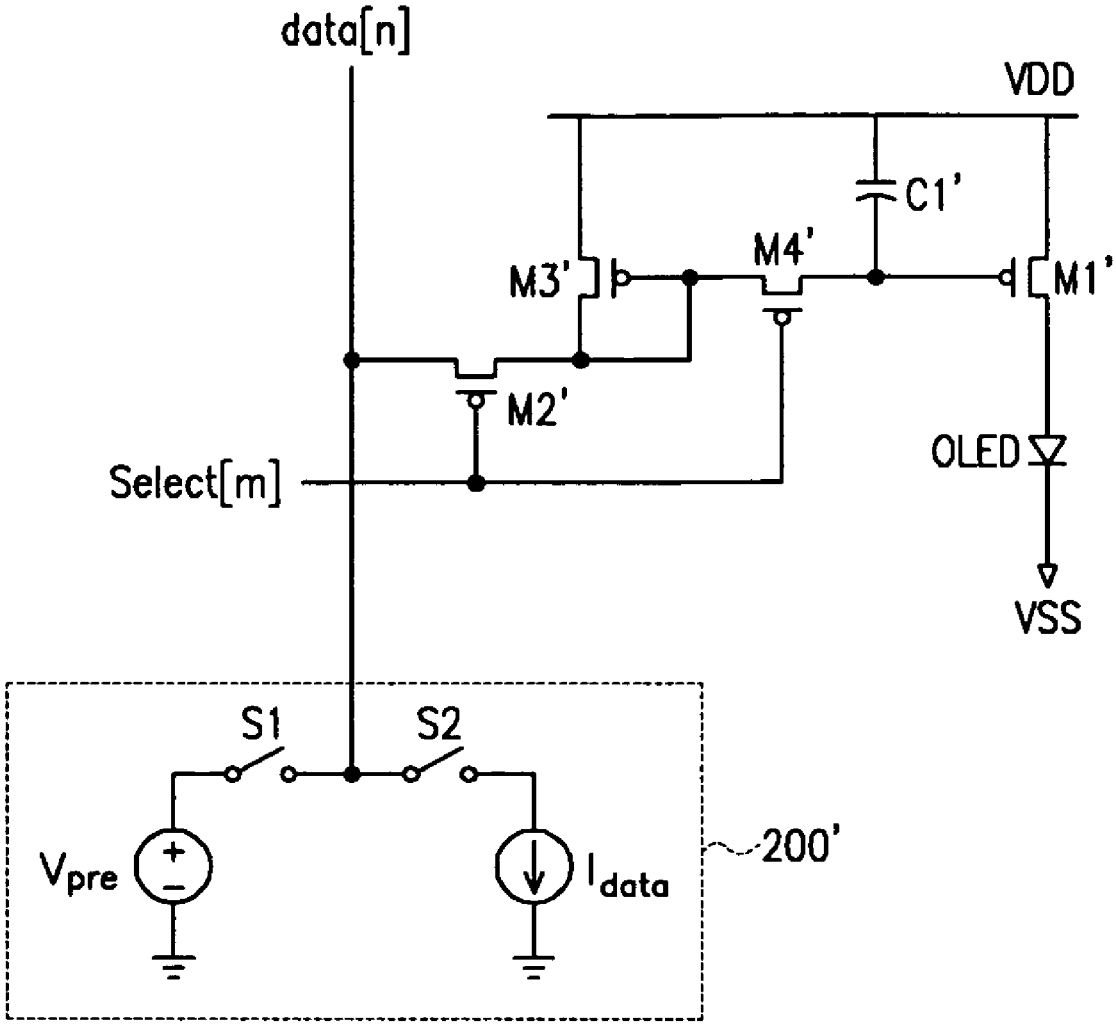
FIG. 6 shows a pixel circuit and a data driving circuit according to another exemplary embodiment of the present invention.

FIG. 6 shows a case of applying the driving method according to the exemplary embodiment to another current programming type pixel circuit.

The pixel circuit of FIG. 6 includes transistors M1', M2', M3' and M4', a capacitor C1', and an OLED. In FIG. 6, a driving transistor M1' is coupled between a power source VDD and an OLED, the other end of which is coupled to a power source VSS. A capacitor C1' is coupled between a source and a gate of the driving transistor M1'. A transistor M4' is coupled between a gate of a transistor M3' and the gate of the driving transistor M1'. A source of the transistor M3', which is diode-connected, is coupled to the power source VDD. A transistor M2' is coupled between a data line data[n] and the gate of the transistor M3', and a gate of the transistor M2' is coupled to a select signal Select[m]. The data line data[n] is coupled to a data driver 200'.

The data driver 200' includes a data current source and a precharge voltage source, precharges the data line with an appropriate precharge voltage before a corresponding pixel is selected, and when the corresponding pixel is selected, the data driver 200' supplies the data current so that the desired data current may be programmed to the data line data[n] within a pixel select time.

In the pixel circuit of FIG. 6, the data programming time can be reduced by increasing the ratio of W/L (width/length) of the driving transistor M1' and that of the mirror transistor M3', and the ratio can be reduced by precharging the data line data[n] since the data can be programmed in the lower current level within the pixel select period. As a result, since the area occupied by the driving transistor M1' and the mirror transistor M3' is reduced, the aperture ratio of the image display device is increased, and since the data current is reduced, power consumption is reduced.

The respective transistors of FIGS. 4 to 6 are realized with p-channel MOS transistors. However, a person skilled in the art would recognize that the scope of the present invention is not limited to the specific type of the transistors. On the contrary, the pixel circuit can be realized with various suitable types of transistors which include first to third terminals and control the amount of current flowing to the third terminal from the second terminal according to the voltage applied between the first and second terminals.

3. Precharge Voltage Establishing Method

Figure 7:
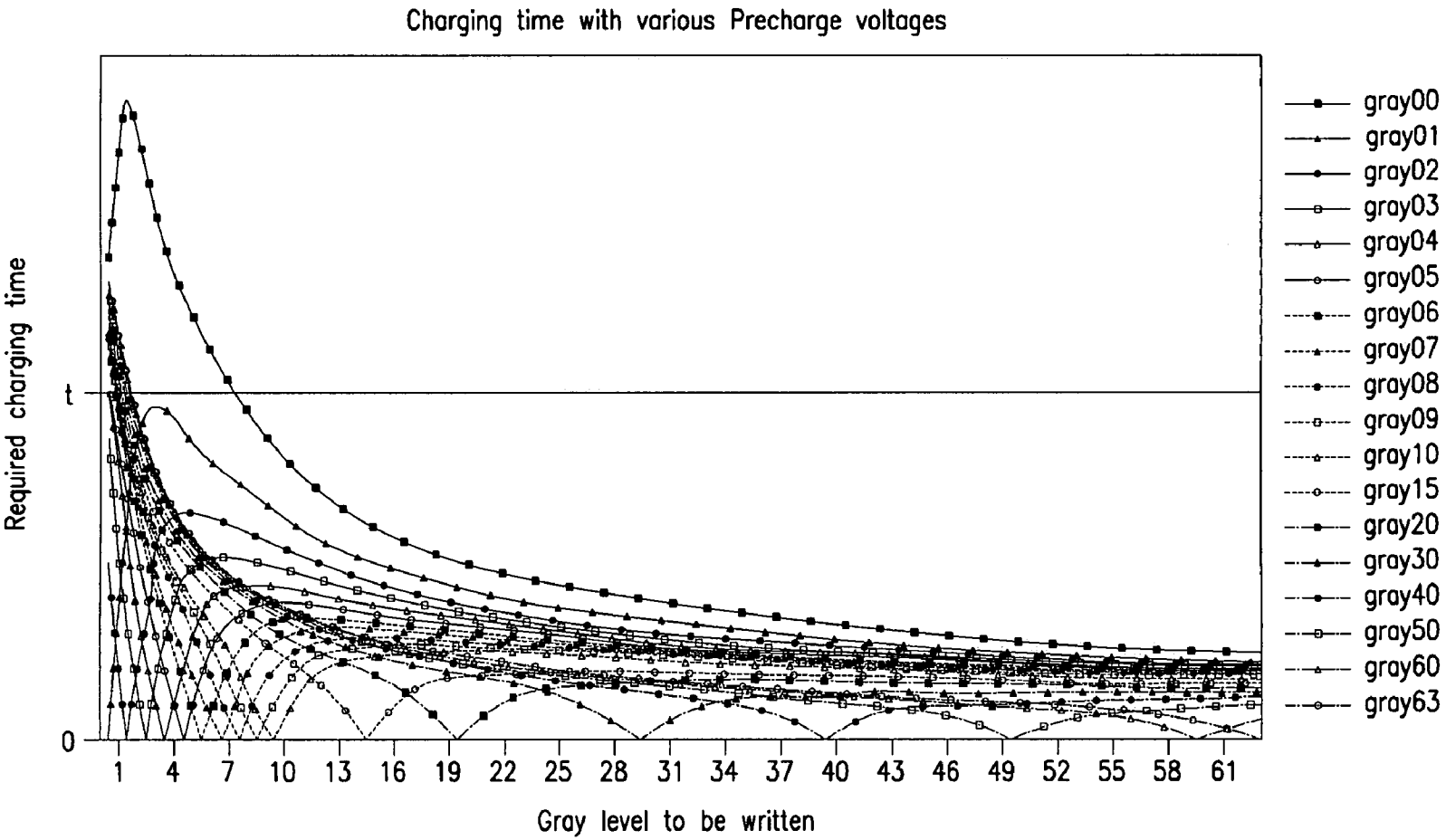
FIG. 7 is a graph for showing variation of data programming times of gray levels according to the data programmed to the pixel coupled to the previous scan line in an image display device.
Figure 8:
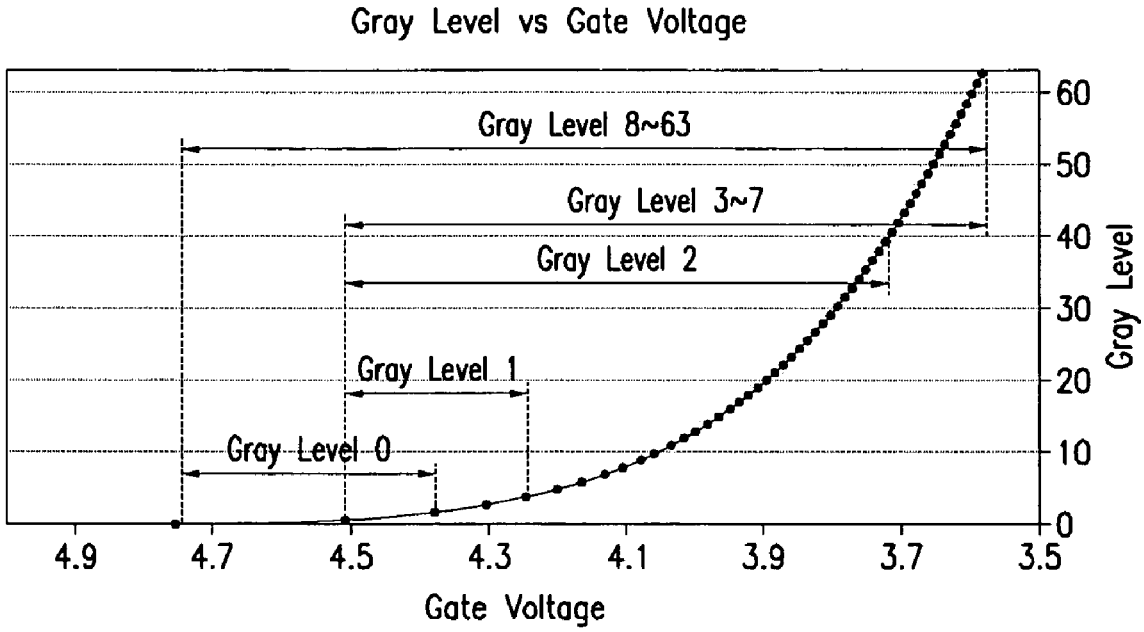
FIG. 8 shows a voltage range of the previous line for programming the data current within a select time.

Referring to FIGS. 7 and 8, the precharge voltage Vpre applied to the data line at the time of a precharge operation will be described.

FIG. 7 is a graph for showing variation of data programming times of gray levels according to the data programmed to the pixel circuit coupled to the scan line selected just before the corresponding scan line is selected in an image display device, and FIG. 8 shows a voltage range of the previous line for programming the data current within a select time.

In FIG. 7, the horizontal axis indicates gray levels of data programmed to the pixel circuit coupled to the previous scan line, and the vertical axis depicts time required for programming the data to the pixel circuit.

In detail, when the gray level of the data programmed to the pixel circuit coupled to the previous scan line is 8, the time required for programming data of gray level 8 reaches almost 0 since there is no difference between the voltage level of the data line data[n] and the target voltage (the voltage that corresponds to the current data) in the gray level of 8 (which indicates a point on which the curve meets the horizontal axis).

As the gray level becomes far from the gray level of 8, the difference between the voltage level of the data line data[n] and the target voltage becomes larger, and the time required for data programming is increased. The time required for data programming is inversely proportional to the magnitude of the data current for driving the data line data[n]. Accordingly, when the gray level is lowered, the data current for driving the data line is reduced, and the time needed for data programming is steeply increased, and when the gray level becomes higher, the data current for driving the data line data[n] is increased, and hence, when the gray level exceeds a certain level, the time required for data programming is reduced.

In accordance with the above description, the curve of FIG. 7 is abruptly decreased in the positive horizontal direction, it is increased after it touches the horizontal axis, it forms a local maximum, and it is gradually reduced.

When a pixel line select time is given as 't' in FIG. 7, the data can be programmed within the scan line select time irrespective of the data of the pixel circuit coupled to the previous scan line in the case when the gray level is greater than 8, and a programming time of greater than the select time is required in the case where the gray level is less than 7 because of the voltage at the parasitic capacitance of the data line data[n] according to the data programmed to the pixel circuit coupled to the previous scan line. As shown in FIG. 8, as the gray level approaches the black which is a gray level of 0, the data current is decreased, the voltage range of the data line data[n] to be changed is increased, and the data programming time is steeply increased.

It can be seen in FIG. 7 that the data can be programmed in the case where the gray levels are between 3 to 7 within the select time when the data programmed to the pixel circuit coupled to the previous scan line have the gray levels of from 1 to 63. It can also be seen that the data can be programmed in the case where the gray level is 2 within the select time when the data programmed to the pixel circuit coupled to the previous scan line have the gray levels in the range of 1 to 40. Also, the data can be programmed in the case where the gray level is 1 within the select time when the data programmed to the pixel circuit coupled to the previous scan line have the gray levels in the range of 1 to 4, and the data can be programmed in the case where the gray level is 0 within the select time when the data programmed to the pixel circuit coupled to the previous scan line have the gray levels in the range of 0 to 2.

Therefore, when the data programmed to the pixel circuit coupled to the previous scan line have the gray levels of between 1 and 2, all of the gray levels can be programmed within the select time.

That is, as shown in FIGS. 7 and 8, there is a voltage range of the data line for programming the data of all the gray levels within a select time, and the voltage range represents a voltage range which corresponds to the gray levels of 1 and 2. It is found from simulation results that the voltage range is a voltage range charged in the data line data[n] when the current that ranges from 1/63 to 8/63 of the maximum data current flows. The above-noted voltage range is referred to as a first precharge voltage range $R_{Vpre1}$.

A method for establishing a precharge voltage according to a second exemplary embodiment of the present invention will be described in consideration of deviation of the threshold voltages of driving transistors included in the respective pixel circuits.

The method for establishing a precharge voltage estimates the deviation of the threshold voltages of the driving transistors of the pixel circuits, and reflects the estimated deviation on the first precharge voltage range $R_{Vpre1}$.

In detail, the voltage at the gate is lowered by |ΔV1| when the same current as that of the driving transistor M1 flows to a pixel in which the threshold voltage at the driving transistor is greater than the threshold voltage (referred to as a first threshold voltage hereinafter) at the driving transistor M1 which was used for establishing the first precharge voltage range $R_{Vpre1}$ by |ΔV1|. Therefore, the case in which the data line is precharged with the predetermined voltage Vpre1 provided in the first precharge voltage range $R_{Vpre1}$ corresponds to the case of applying the precharge voltage of Vpre1+|ΔV1|, when the magnitude of the threshold voltage of the driving transistor is increased by |ΔV1|, and the precharge voltage applied to the data line may fall outside the first precharge voltage range $R_{Vpre1}$.

In the pixel in which the threshold voltage of the driving transistor is less than the first threshold voltage by |ΔV2|, the voltage applied to the gate of the driving transistor M1 is increased by |ΔV2| when the same current as that of the driving transistor M1 flows to the pixel. Therefore, the case in which the data line is precharged with the predetermined voltage Vpre1 provided in the first precharge voltage range $R_{Vpre1}$ corresponds to the case of applying the precharge voltage of Vpre1−|ΔV2|, when the magnitude of the threshold voltage of the driving transistor is decreased by |ΔV2|, and the precharge voltage applied to the data line may fall outside the first precharge voltage range $R_{Vpre1}$.

Therefore, the precharge voltage Vpre2 according to the second exemplary embodiment is established to be within the second precharge voltage range $R_{Vpre2}$ which is lower than the maximum of the first precharge voltage range $R_{Vpre1}$ by |ΔV1| and higher than the minimum of the first precharge voltage range $R_{Vpre1}$ by |ΔV2|.

That is, when it is defined that the first threshold voltage value is given as Vth1 and the range of the threshold voltage at the driving transistor of each pixel is given in Equation 1, the second precharge voltage range $R_{Vpre2}$ according to the second exemplary embodiment of the present invention is given as Equation 2.

$$|V_{th1}|-|\Delta V2|<|V_{th}|<|V_{th1}|+|\Delta V1| \quad \text{Equation 1}$$

$$V_a+|\Delta V2|<V_{pre2}<V_b-|\Delta V1| \quad \text{Equation 2}$$

where Va is the minimum of the first precharge voltage Vpre1, and Vb is the maximum thereof.

A method for establishing a precharge voltage according to a third exemplary embodiment of the present invention will be described.

The method for establishing a precharge voltage according to the third exemplary embodiment estimates a deviation of the voltage level from the power source VDD of a pixel caused by voltage drop due to current through power (VDD) lines, and reflects the estimated deviation on the first precharge voltage range $R_{Vpre1}$.

In detail, when the voltage level of the power source VDD is defined as VDD1, the voltage levels of the power (VDD) lines become VDD1 when displaying black over the whole panel, since there is no voltage drop through the parasitic resistance of the power(VDD) lines. Also, when displaying white over the whole panel, the voltage drop is most severe because of the maximum current flows through the parasitic resistance of the power lines, and different voltage levels of power are supplied to the respective pixels. It is defined below that the lowest voltage level from among the voltage levels is VDD2, and the difference between the voltage level VDD1 of the power VDD and the lowest voltage level VDD2 is given as |ΔVDD|.

In this instance, when the same current as that of the driving transistor M1 flows to the pixel where a power of the voltage level of (VDD1−|ΔVDD|) is supplied, the gate voltage of the driving transistor is lowered by |ΔVDD|, and applying the precharge voltage of Vpre1 to this pixel is equivalent to applying the precharge voltage of (Vpre1+|ΔVDD|) to the pixel with the power of VDD1 level supplied to.

Therefore, the precharge voltage Vpre3 according to the third exemplary embodiment of the present invention is established within the third precharge voltage range $R_{Vpre3}$ shown in Equation 3 in consideration of the voltage drop caused by the parasitic resistance of the power (VDD) lines.

$$V_{pre3}<V_b-|\Delta VDD| \quad \text{Equation 3}$$

where Vb is the maximum of the first precharge voltage Vpre1.

The precharge voltage Vpre4 according to a fourth exemplary embodiment of the present invention is established in consideration of the deviation of the threshold voltage of the driving transistor M1 and the voltage drop along the power lines. The fourth precharge voltage range $R_{Vpre4}$ according to the fourth exemplary embodiment of the present invention is given in Equation 4, and Equation 4 can also be expressed as Equation 5 in a simpler format.

$$V_{pre4}+|\Delta V1|+|\Delta VDD|<V_b$$

$$V_a<V_{pre4}-|\Delta V2| \quad \text{Equation 4}$$

$$V_a+|\Delta V2|<V_{pre4}<V_b-|\Delta V1|-|\Delta VDD| \quad \text{Equation 5}$$

The precharge voltage ranges applicable to all the pixel circuits have been described. Since the precharge voltage ranges become different according to the data current programmed to the data line, it is desirable to use different precharge voltages according to RGB (red, green, and blue) when the image display device includes RGB pixels which uses different data currents in order to display color images.

Also, in the case of using the pixel circuit of FIG. 6, the RGB pixels can be configured to substantially use the same data current by varying the current ratio of the driving transistor M1 and the mirror transistor M3, and in this instance, substantially the same precharge voltage is used for all the RGB pixels.

A method for establishing the precharge voltage according to a fifth exemplary embodiment of the present invention will be described.

The precharge voltage is established according to the case that the data to be programmed are black and the cases that the data to be programmed are other than black.

In detail, as shown in FIG. 7, when the data with the gray level of near 0 (black) are programmed, the data current is decreased, the voltage range of the data line to be changed is widened, and the programming time is steeply increased. Therefore, it is difficult to obtain the precharge voltage satisfying Equation 5 when programming the data with the gray level of near 0.

To solve this problem, the voltage of the gray level of 0 can be controlled to be nearer to the voltage of the gray voltage of 1, which reduces the contrast and therefore is problematic.

Therefore, the data line data[n] is precharged with the voltage level of the power source VDD when the black data are programmed in the fifth exemplary embodiment of the present invention.

That is, the pixel circuit is driven by the voltage programming method with the precharge voltage as the data since the data line data[n] is floated when the black data are programmed. Therefore, appropriate image uniformity and contrast ratio are obtained by establishing the precharge voltage as the voltage level of the power VDD so that an equivalent resistance of the driving transistor M1 may be large enough.

As described, a desired data current is programmed within the pixel select time by precharging the data lines with a precharge voltage estimated to guarantee the data programming time. The precharge voltage may be varied according to image display devices, and may be previously established through simulation before driving it. Also, the data line can be programmed with the voltage for guaranteeing the data programming time of part of generally used gray levels, without finding the common voltage condition of all the gray levels.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An image display device comprising:

a plurality of pixel circuits, each said pixel circuit for displaying an image which corresponds to a corresponding one of data currents, which is applied thereto;

a plurality of data lines for transmitting the data currents to the pixel circuits;

a plurality of scan lines for transmitting select signals to the pixel circuits; and a driver for applying a precharge voltage to a corresponding one of the data lines in response to a first control signal, and supplying the corresponding one of the data currents to the corresponding one of the data lines in response to a second control signal.

2. The image display device of claim 1, wherein the first control signal is applied to the driver before the second control signal is applied.

3. The image display device of claim 2, wherein the precharge voltage is provided within a range of a voltage charged in a parasitic capacitance of the corresponding one of the data lines when the current in a range from 1/63 to 8/63 of the maximum of the corresponding one of the data currents flows to the corresponding one of the data lines.

4. The image display device of claim 2, wherein the precharge voltage is a voltage between a first voltage corresponding to a first gray level and a second voltage corresponding to a second gray level when the corresponding one of the data currents is programmed within a select time of a corresponding one of the scan lines coupled to a first said pixel circuit, when the corresponding one of the data currents corresponding to a gray level between the first gray level and the second gray level is applied to another said pixel circuit coupled to another one of the scan lines which is selected before the corresponding one of the scan lines coupled to the first said pixel circuit is selected.

5. The image display device of claim 4, wherein each said pixel circuit comprises: a display element for displaying the image in correspondence to an amount of a current, which is applied thereto; a first power end coupled to a first power source; and a driving transistor for applying the current which corresponds to the data current to the display element, the driving transistor being coupled between the first power end and the display element, and wherein the precharge voltage is a voltage between a second voltage and a fourth voltage when the first voltage is nearer to a voltage of the first power source than the second voltage, a difference between the maximum and an average of absolute values of threshold voltages of the driving transistors included in the pixel circuits is a third voltage, and a voltage which is far from the voltage of the first power source by the third voltage compared to the first voltage is the fourth voltage.

6. The image display device of claim 5, wherein the precharge voltage is a voltage between the fourth voltage and a sixth voltage when a difference between an average and the minimum of the absolute values of the threshold voltages of the driving transistors included in the pixel circuits is a fifth voltage, and a voltage which is near the voltage of the first power source by the fifth voltage compared to the second voltage is the sixth voltage.

7. The image display device of claim 4, wherein each said pixel circuit comprises: a display element for displaying the image in correspondence to an amount of a current, which is applied thereto; a first power end coupled to a first power source; and a driving transistor for applying the current which corresponds to the data current to the display element, the driving transistor being coupled between the first power end and the display element, and wherein the precharge voltage is a voltage between a second voltage and a fourth voltage when the first voltage is nearer to a voltage of the first power source than the second voltage, a difference between the maximum and the minimum of voltages of first power ends included in the pixel circuits is a third voltage, and a voltage which is far from the voltage of the first power source by the third voltage compared to the first voltage is a fourth voltage.

8. The image display device of claim 7, wherein the precharge voltage is a voltage between a seventh voltage and an eighth voltage when a difference between the maximum and an average of the absolute values of the threshold voltages of the driving transistors included in the pixel circuits is a fifth voltage, a difference between the average and the minimum is a sixth voltage, a voltage which is far from the voltage of the first power source by the fifth voltage compared to the fourth voltage is the seventh voltage, and a voltage which is near to the voltage of the first power by the sixth voltage compared to the second voltage is the eighth voltage.

9. The image display device of claim 1, wherein the precharge voltage is provided within a voltage range which allows the corresponding one of the data currents to be programmed to a corresponding one of the pixel circuits within a select time of a corresponding one of the scan lines.

10. The image display device of claim 1, wherein the driver applies substantially the same precharge voltage to the data lines.

11. The image display device of claim 1, wherein the driver applies a first precharge voltage to the corresponding one of the data lines for transmitting the corresponding one of the data currents with a gray level of substantially 0 to a corresponding one of the pixel circuits, and applies a second precharge voltage to other said data lines.

12. The image display device of claim 11, wherein the first precharge voltage substantially corresponds to a power supply voltage applied to the corresponding one of the pixel circuits.

13. The image display device of claim 11, wherein the second precharge voltage is provided within a range of a voltage charged in a parasitic capacitance of one of the other said data lines when a current in a range of from 1/63 to 8/63 of the maximum of a corresponding said data current flowing to the one of the other said data lines.

14. The image display device of claim 11, wherein the precharge voltage is a voltage between a first voltage corresponding to a first gray level and a second voltage corresponding to a second gray level when the corresponding one of the data currents is programmed within a select time of a corresponding one of the scan lines coupled to a first said pixel circuit, when the data current corresponding to a gray level between the first gray level and the second gray level is applied to another said pixel circuit coupled to another one of the scan lines, which is selected before the corresponding one of the scan lines coupled to the first said pixel circuit is selected.

15. The image display device of claim 1, wherein different precharge voltages are applied to the data lines for programming the data currents to the pixel circuits driven within different current ranges when at least two pixel circuits from among the pixel circuits are driven within different data current ranges.

16. The image display device of claim 1, wherein the scan lines comprise a select scan line for transmitting a first said select signal for selecting pixels, and a light emitting scan line for transmitting a second said select signal for controlling a light emitting period of the pixel circuits.

17. The image display device of claim 16, wherein each said pixel circuit comprises:

a display element for displaying the image in correspondence to an amount of a current, which is applied thereto;

a driving transistor including a first end, a second end coupled to a power source, and a third end, the driving transistor for controlling the current which flows to the third end from the second end according to a voltage applied to the first end;

a first switch for transmitting the current which flows through the driving transistor to the display element in response to the second said select signal;

a second switch for transmitting the corresponding one of the data currents which flows from the corresponding one of the data lines to the first end of the driving transistor in response to the first said select signal;

a third switch for transmitting the current which flows from the data line to the third end of the driving transistor in response to the first said select signal; and a capacitor coupled between the first end and the second end of the driving transistor.

18. The image display device of claim 17, wherein the first, second and third switches are realized with transistors which are of the same type as that of the driving transistor.

19. The image display device of claim 1, wherein each said pixel circuit comprises:

a display element for displaying the image in correspondence to an amount of a current, which is applied thereto;

a driving transistor including a first end, a second end coupled to a power source, and a third end, the driving transistor for controlling the current which flows to its third end from its second end according to a voltage applied to the first end;

a mirror transistor including a first end, a second end coupled to the power source, and a third end, the mirror transistor for controlling a current which flows to its third end from its second end according to the voltage applied to the first end, and the mirror transistor being diode-connected;

a first switch for transmitting the corresponding one of the data currents which flows from a corresponding one of the data lines to the third end of the mirror transistor in response to a corresponding one of the select signals;

a second switch for coupling the first end of the driving transistor to the first end of the mirror transistor in response to the corresponding one of the select signals; and a capacitor coupled between the first end and the second end of the driving transistor.

20. The image display device of claim 19, wherein the first switch and the second switch are of the same type as that of the driving transistor.

21. The image display device of claim 1, wherein each said pixel circuit includes a driving transistor for driving a display element, wherein a voltage range of the precharge voltage is variable depending on a threshold voltage of the driving transistor of a corresponding one of the pixel circuits.

22. The image display device of claim 1, wherein a voltage range of the precharge voltage is variable depending on a voltage level of a power supply voltage applied to a corresponding one of the pixel circuits.

23. A method for driving an image display device including a plurality of pixel circuits, a plurality of data lines for programming data currents to the pixel circuits, and a plurality of scan lines for transmitting select signals to the pixel circuits, the method comprising:

applying a precharge voltage to a corresponding one of the data lines in response to a first control signal; and supplying a corresponding one of the data currents to the corresponding one of the data lines in response to a second control signal.

24. The method of claim 23, wherein applying a precharge voltage comprises applying substantially the same precharge voltage to the data lines.

25. The method of claim 23, wherein the precharge voltage is provided within a range of a voltage for allowing the corresponding one of the data currents to be programmed to a corresponding one of the pixel circuits within a select time of a corresponding one of the scan lines.

26. The method of claim 25, wherein the precharge voltage is provided within a range of a voltage charged in a parasitic capacitance of the corresponding one of the data lines when the current in a range of from 1/63 to 8/63 of the maximum of the corresponding one of the data currents flows to the corresponding one of the data lines.

27. The method of claim 25, wherein the precharge voltage is a voltage between a first voltage corresponding to a first gray level and a second voltage corresponding to a second gray level when the corresponding one the data currents is programmed within the select time of the corresponding one of the scan lines coupled to a first said pixel circuit, when the corresponding one of the data currents corresponding to a gray level between the first gray level and the second gray level is applied to another said pixel circuit coupled to another one of the scan lines which is selected before the corresponding one of the scan lines coupled to the first said pixel circuit is selected from among the pixel circuits.

28. The method of claim 23, wherein the driver applies a first precharge voltage to the corresponding one of the data lines for transmitting the corresponding one of the data currents with the gray level of substantially 0 to a corresponding one of the pixel circuits, and applies a second precharge voltage to other said data lines.

29. The method of claim 28, wherein the first precharge voltage is substantially the same as the power supply voltage applied to the corresponding one of the pixel circuits.

30. The method of claim 28, wherein the second precharge voltage is provided within a range of a voltage charged in a parasitic capacitance of one of the other said data lines when the current in a range of from 1/63 to 8/63 of the maximum of the corresponding one of the data currents flows to the one of the other said data lines.

31. A method for establishing a precharge voltage of an image display device including a plurality of pixel circuits, each said pixel circuit for displaying an image corresponding to a data current, which is applied thereto, a plurality of data lines for transmitting data currents to the pixel circuits, and a plurality of scan lines for transmitting select signals to the pixel circuits, the method comprising:

applying the precharge voltage to a corresponding one of the data lines before a corresponding one of the data currents is transmitted to the corresponding one of the data lines; and establishing the precharge voltage to be a voltage between a first voltage corresponding to a first gray level and a second voltage corresponding to a second gray level when a corresponding one of the data currents is programmed within a select time of a corresponding one of the scan lines coupled to a first said pixel circuit, when the corresponding one of the data currents corresponding to a gray level between the first gray level and the second gray level is applied to another said pixel circuit coupled to another one of the scan lines which is selected before the corresponding one of the scan lines coupled to the first said pixel circuit is selected.

* * * * *

UNITED STATES PATENT AND TRADEMARK OFFICE

CERTIFICATE OF CORRECTION

PATENT NO. : 7,501,999 B2
APPLICATION NO. : 10/954329
DATED : March 10, 2009
INVENTOR(S) : Dong-Yong Shin et al.

It is certified that error appears in the above-identified patent and that said Letters Patent is hereby corrected as shown below:

In the Claims

Column 14, line 28, Claim 27 After "one" insert -- of --

Signed and Sealed this

Thirteenth Day of July, 2010

David J. Kappos

David J. Kappos
*Director of the United States Patent and Trademark Office*